US008986042B2

(12) United States Patent
Mongold

(10) Patent No.: US 8,986,042 B2
(45) Date of Patent: Mar. 24, 2015

(54) SQUARE RF ELECTRICAL CONTACT AND METHOD OF MANUFACTURING THE SAME

(75) Inventor: John Mongold, Middletown, PA (US)

(73) Assignee: Samtec, Inc., New Albany, IN (US)

( * ) Notice: Subject to any disclaimer, the term of this patent is extended or adjusted under 35 U.S.C. 154(b) by 1362 days.

(21) Appl. No.: 12/117,888

(22) Filed: May 9, 2008

(65) Prior Publication Data

US 2009/0280681 A1 Nov. 12, 2009

(51) Int. Cl.

| | |
|---|---|
| ***H01R 9/05*** | (2006.01) |
| ***H01R 13/11*** | (2006.01) |
| ***H01R 24/50*** | (2011.01) |
| ***H01R 43/16*** | (2006.01) |
| *H01R 103/00* | (2006.01) |

(52) U.S. Cl.

CPC ..... *H01R 9/05* (2013.01); *H01R 13/114* (2013.01); *H01R 24/50* (2013.01); *H01R 43/16* (2013.01); *H01R 2103/00* (2013.01)

USPC ..... 439/578

(58) Field of Classification Search

USPC ..... 439/63, 579, 681, 607.31, 660, 884

See application file for complete search history.

(56) References Cited

U.S. PATENT DOCUMENTS

| | | | | |
|---|---|---|---|---|
| 5,011,415 | A * | 4/1991 | Suzuki et al. | 439/63 |
| 5,108,300 | A * | 4/1992 | Weber | 439/188 |
| 5,973,267 | A * | 10/1999 | Huang | 174/102 R |
| 6,447,311 | B1 * | 9/2002 | Hu et al. | 439/108 |
| 6,824,412 | B2 * | 11/2004 | Clement | 439/290 |
| 2005/0272311 | A1 * | 12/2005 | Tsao | 439/578 |
| 2006/0228491 | A1 * | 10/2006 | Choi et al. | 427/458 |
| 2007/0238339 | A1 * | 10/2007 | Ting | 439/159 |
| 2008/0038958 | A1 * | 2/2008 | Xiang | 439/571 |
| 2008/0214045 | A1 * | 9/2008 | Tu et al. | 439/540.1 |

* cited by examiner

*Primary Examiner* — Ross Gushi

(74) *Attorney, Agent, or Firm* — Keating & Bennett, LLP

(57) ABSTRACT

An electrical contact includes a female portion having a conductive sheath, a dielectric disposed within the conductive sheath, and a center conductor extending through the dielectric; and a male portion having a conductive sheath, a dielectric disclosed within the conductive sheath, and a center conductor extending through the dielectric. The female portion and the male portion are arranged to be engageable with one another. The conductive sheath, center conductor, and dielectric of each of the female portion and the male portion have a substantially square shape. Each of the center conductors of the female portion and the male portion includes a contact portion. The contact portions of the female and male portions are arranged to be engaged with one another when the female portion and the male portion are engaged with one another. The contact portion of each of the center conductors of the female portion and the male portion has a thickness of substantially half of a thickness of the remaining portions of the center conductors.

18 Claims, 23 Drawing Sheets

SQUARE RF ELECTRICAL CONTACT AND METHOD OF MANUFACTURING THE SAME

BACKGROUND OF THE INVENTION

1. Field of the Invention

The present invention relates to electrical contacts and more specifically, the present invention relates to square radio frequency (RF) electrical contacts having a center conductor, an insulating layer, and a conductive sheath having substantially square cross-sections.

2. Description of the Related Art

Electrical contacts are used to place electrical devices, such as printed circuit boards, in communication with one another. An electrical contact includes two portions, one portion of which is arranged to be connected to a first electrical device and the second portion of which is arranged to be connected to a second electrical device to be put into communication with the first device. To connect the two devices, the two portions of the electrical contacts are mated together.

One conventional type of RF electrical contact is a coaxial contact. A coaxial contact has a substantially cylindrical cross-section, and includes a center conductor, an insulating layer, and a conductive sheath. One problem with conventional coaxial contacts is that, due to the substantially cylindrical cross-sectional shape, conventional coaxial contacts must be screw machined, which is an expensive, time consuming process and which requires very tight manufacturing tolerances. Thus, conventional coaxial contacts are relatively expensive to manufacture.

Further, screw machined RF connectors have a low cycle life due to high normal force and machined mating surfaces. In addition, screw machined RF connectors have virtually no misalignment allowance because they are circular and the contact beams do not allow for the mating connectors to be out of location.

SUMMARY OF THE INVENTION

To overcome the problems described above, preferred embodiments of the present invention provide an electrical contact which can be produced faster and at a reduced cost as compared to a coaxial contact, and which still maintains consistent geometry throughout the entire length of the mated stack height to reduce signal integrity discontinuities.

An electrical contact according to a preferred embodiment of the present invention includes a female portion including a conductive sheath, a dielectric disposed within the conductive sheath, and a center conductor extending through the dielectric, and a male portion including a conductive sheath, a dielectric disclosed within the conductive sheath, and a center conductor extending through the dielectric, wherein the female portion and the male portion are arranged to be engageable with one another, the conductive sheath, the center conductor, and the dielectric of each of the female portion and the male portion have a substantially square shape, each of the center conductors of the female portion and the male portion includes a contact portion arranged to be engaged with one another when the female portion and the male portion are engaged with one another, and the contact portion of each of the center conductors of the female portion and the male portion has a thickness of substantially half of a thickness of the remaining portions of the center conductors.

The contact portion of the center conductor of the male portion preferably has a width that is greater than a width of the contact portion of the center conductor of the female portion.

The conductive sheath of the female portion preferably has inner dimensions that are greater than outer dimensions of the conductive sheath of the male portion such that a space is provided between the conductive sheath of the female portion and the conductive sheath of the male portion.

Preferably, the dielectric of the female portion includes a block portion and a frame portion extending from the block-shaped portion, the frame portion has an opening extending therethrough, and the contact portion of the center conductor of the female portion is disposed adjacent to the opening in the frame-shaped portion.

Preferably, the block portion of the dielectric of the female portion includes a through-hole extending therethrough, the center conductor of the female portion includes at least one projection extending from an intermediate portion thereof, and the center conductor of the female portion extends through the opening in the block portion of the dielectric of the female portion such that the at least one projection is engaged with a side surface of the through-hole in the block portion of the dielectric of the female portion.

Preferably, the dielectric of the male portion includes a block portion and a support portion extending from the block portion, the support portion has a groove disposed in a surface thereof, and the contact portion of the center conductor of the male portion is disposed in the groove in the surface of the support portion.

The support portion of the dielectric of the male portion preferably includes an opening extending through the support portion from a surface of the groove to a surface of the support portion opposite to the surface in which the groove is disposed.

The female portion preferably includes a plurality of resilient arms arranged to resiliently engage an outer surface of the male portion when the female portion and the male portion are engaged with one another.

Preferably, the conductive sheath of the female portion includes an opening in an intermediate portion thereof, and the dielectric of the female portion includes a projection arranged to engage the opening in the conductive sheath of the female portion when the dielectric of the female portion is disposed in the conductive sheath of the female portion.

Preferably, the conductive sheath of the male portion includes an opening in an intermediate portion thereof, and the dielectric of the male portion includes a projection arranged to engage the opening in the conductive sheath of the male portion when the dielectric of the male portion is disposed in the conductive sheath of the male portion.

Preferably, the conductive sheath of the female portion includes a plurality of terminals extending from an intermediate portion thereof, and the plurality of terminals are arranged to be disposed and soldered in holes provided in a circuit board.

Preferably, the conductive sheath of the male portion includes a plurality of terminals extending from an intermediate portion thereof, and the plurality of terminals are arranged to be disposed and soldered in holes provided in a circuit board.

The conductive sheath of the female portion preferably includes a seam extending substantially in a longitudinal direction of the conductive sheath of the female portion at which two edges of the conductive sheath of the female portion are adjacent to one another.

The conductive sheath of the male portion preferably includes a seam extending substantially in a longitudinal direction of the conductive sheath of the male portion at which two edges of the conductive sheath of the male portion are adjacent to one another.

The edges of the conductive sheath of the male portion adjacent to one another preferably include complementary locking elements arranged to interconnect with one another.

A method of manufacturing an electrical contact according to another preferred embodiment of the present invention includes the steps of forming a conductive sheath by stamping a substantially flat metal plate into a desired shape, and subsequently forming the conductive sheath into a substantially square shape by a progressive die process, providing a center conductor having a substantially square cross sectional shape, forming a dielectric by overmolding a dielectric material into a substantially square shape around the center conductor such that the center conductor is embedded in the dielectric, the substantially square shape of the dielectric substantially corresponds to the substantially square shape of the conductive sheath, and disposing the dielectric including the center conductor embedded therein in the conductive sheath.

The step of forming the dielectric may be preferably performed by injection molding or insert molding.

In the step of forming a conductive sheath, a plurality of the conductive sheaths is preferably formed while being attached to a strip.

In the step of providing the center conductor, a plurality of center conductors is preferably attached to a strip.

In the step of forming a dielectric, a plurality of dielectrics is preferably formed on the plurality of center conductors attached to the strip.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
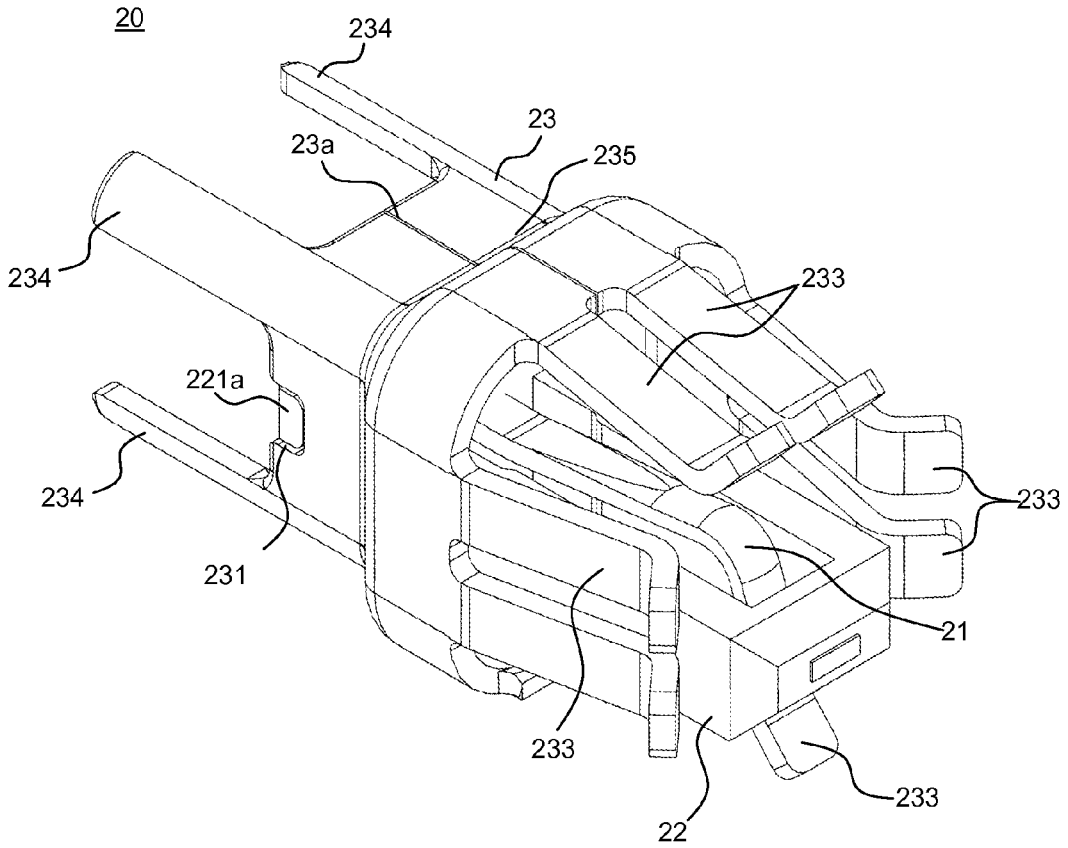
FIG. 1 is a perspective view of the female portion of the electrical contact according to a preferred embodiment of the present invention.

Preferred embodiments of the present invention will now be described with reference to FIGS. 1 to 24B. In the preferred embodiments of the present invention, it is preferable to maintain a substantially square cross-sectional geometry of the center conductor, dielectric, and conductive sheath throughout the length of the contact. By maintaining the substantially square cross-sectional geometry of the center conductor, the dielectric, and the conductive sheath throughout the length of the contact, signal integrity discontinuities are minimized so as to achieve outstanding signal integrity performance.

FIGS. 1-6 show a female portion 20 of an electrical contact 10 or a partial portion of the female portion 20 according to a preferred embodiment of the present invention.

As seen in FIGS. 1-6, the female portion 20 preferably includes a center conductor 21 which extends through a dielectric 22, and the dielectric 22 is disposed within a conductive sheath 23.

Figure 6:
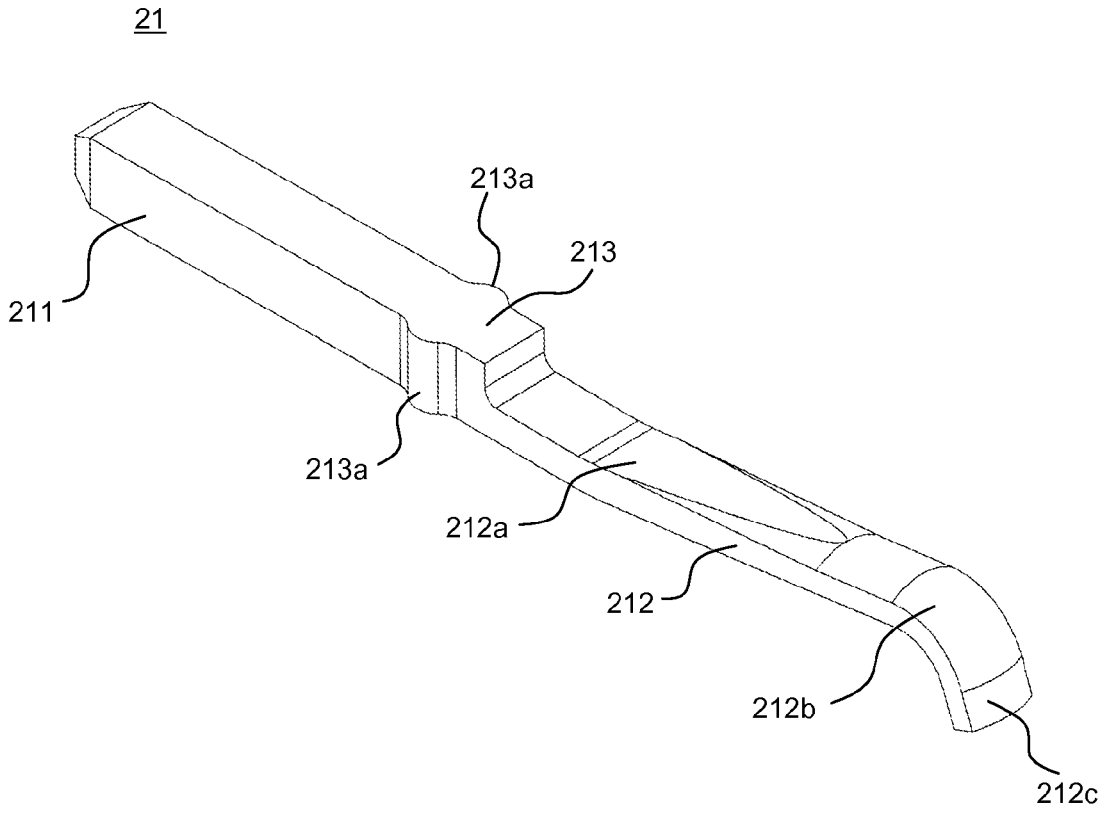
FIG. 6 is a perspective view of the center conductor of the female portion of the electrical contact shown in FIG. 1.

As best seen in FIG. 6, the center conductor 21 includes an intermediate portion 213 connecting a tail portion 211 and a contact portion 212. The intermediate portion 213 includes, for example, projections 213*a* disposed on opposite sides of the intermediate portion 213. The projections 213*a* are arranged to be engageable with the dielectric 22 to fix the location of the center conductor 21 as shown, for example, in FIG. 4. However, any suitable fixing structure may be provided to prevent movement of the center conductor 21 with respect to the dielectric 22.

The contact portion 212 of the center conductor 21 is preferably configured to have a thickness that is approximately half of the thickness of the tail portion 211 and the intermediate portion 213 to enable the contact portion 212 to engage with a contact portion 412 of the male portion 40, which is described below. The contact portion 212 acts as a spring arm such that the contact portions 212 and 412 can be resiliently engaged with one another. The contact portion 212 preferably includes a substantially flat surface 212*a* extending along a portion of the contact portion 212 adjacent to the intermediate portion 213 and a curved surface 212*b* extending along the remaining portion of the contact portion 212. The substantially flat surface 212*a* is configured to be engaged with a substantially flat surface of the contact portion 412 of the male portion 40, and the curved surface 212*b* is configured to facilitate engagement of the contact portion 212 of the center conductor 21 of the female portion 20 with the contact portion 412 of the center conductor 41 of the male portion 40, which is described below. In addition, the contact portion 212 preferably includes an end portion 212*c* that extends away from the substantially flat surface 212*a* of the contact portion 212. In this preferred embodiment, the end portion 212*c* has an arc shape. However, the end portion 212*c* may have any suitable shape as long as it extends away from the substantially flat surface 212*a*.

Figure 4:
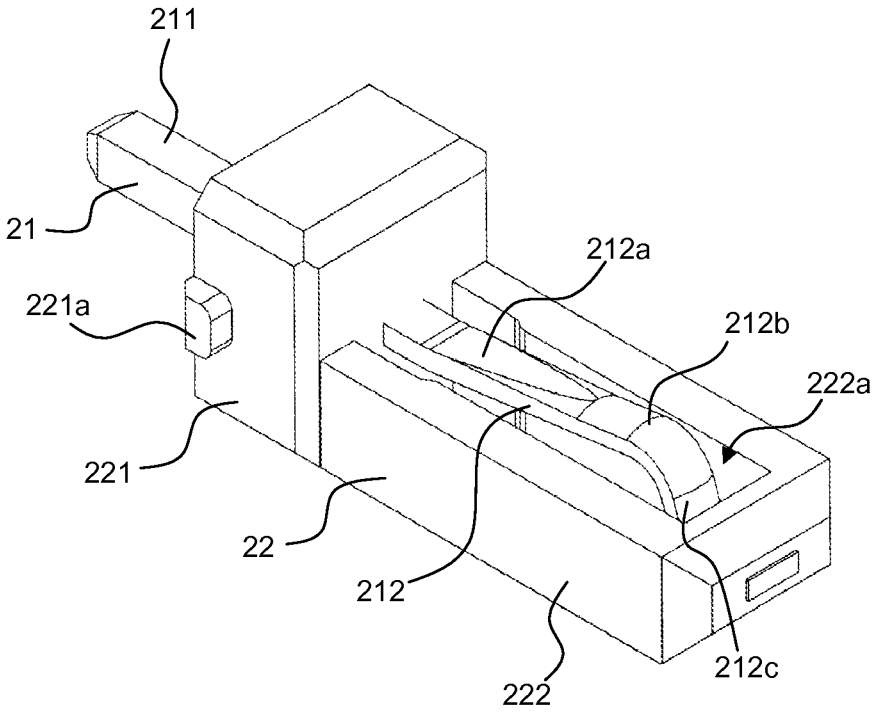
FIG. 4 is a perspective view of a partially assembled portion of the female portion of the electrical contact shown in FIG. 1.
Figure 5:
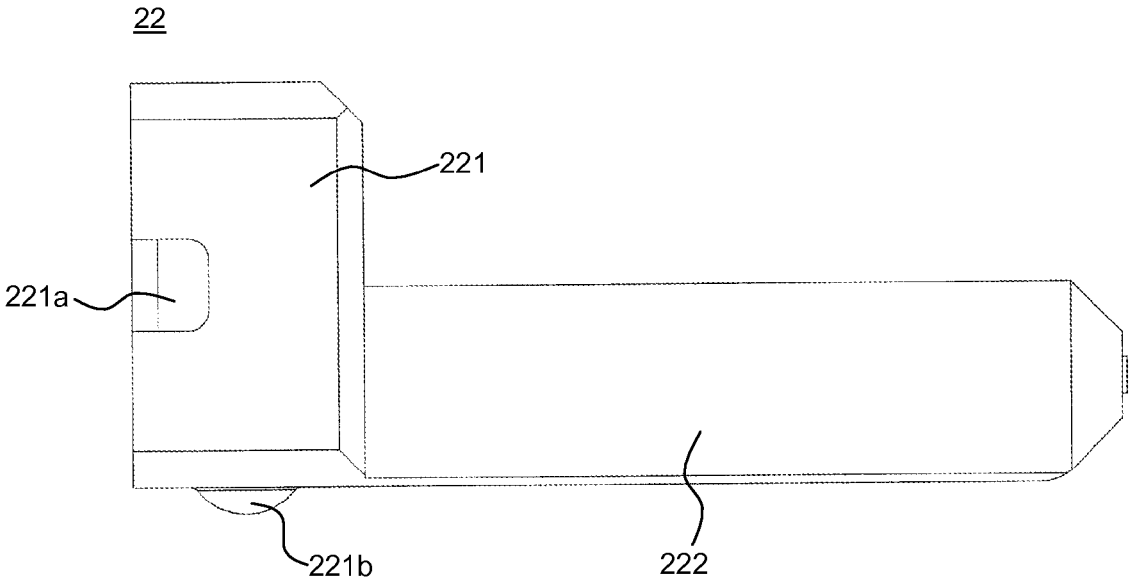
FIG. 5 is a side view of the dielectric of the female portion of the electrical contact shown in FIG. 1.

As best seen in FIGS. 4 and 5, the dielectric 22 is preferably overmolded with the center conductor 21, such that the center conductor 21 is embedded in the dielectric 22. The dielectric 22 includes a block portion 221 and a frame portion 222. The projections 213*a* of the center conductor 21 are provided to prevent the center conductor 21 from moving with respect to the block portion 221 so as to fix the location of the center conductor 21 with respect to the dielectric 22. Alternatively, the dielectric 22 may be formed by injection molding to have a through-hole extending therethrough, and the center conductor 21 may be press-fit into the through-hole.

Figure 2:
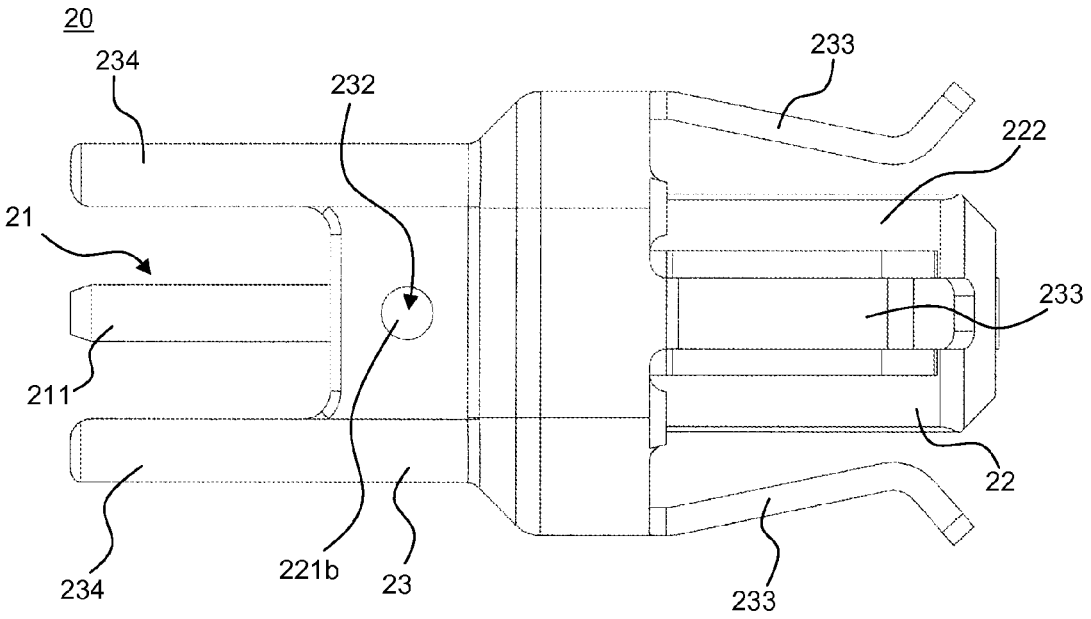
FIG. 2 is a side view of the female portion of the electrical contact shown in FIG. 1.
Figure 3:
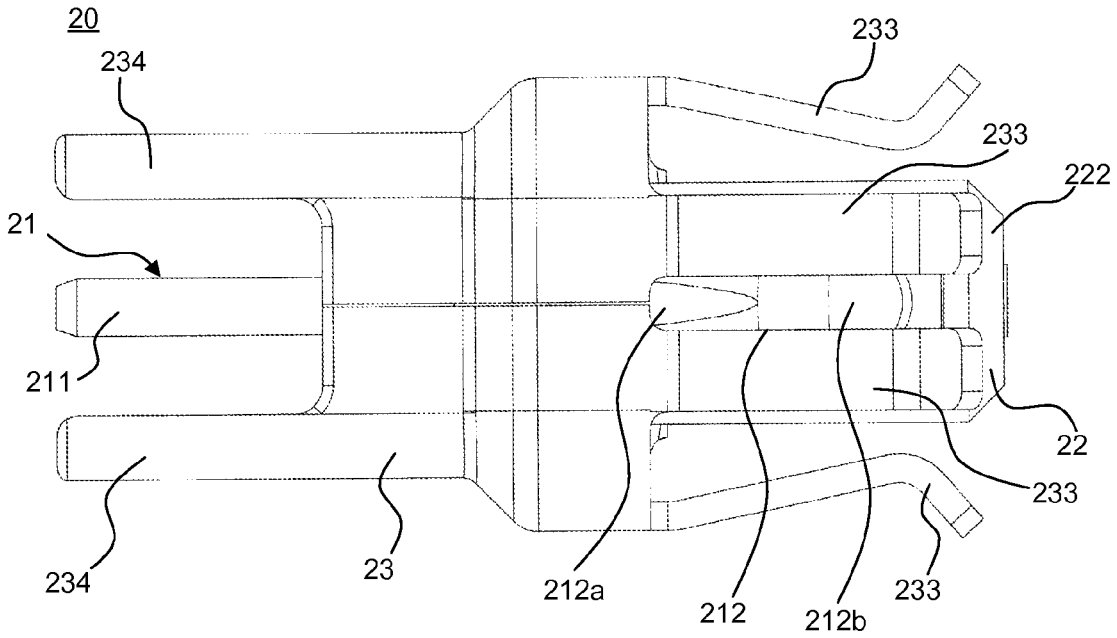
FIG. 3 is another side view of the female portion of the electrical contact shown in FIG. 1.

The block portion 221 preferably includes a projection 221*a* arranged to be disposed in an opening 231 of the conductive sheath 23 (shown in FIG. 1) and a projection 221*b* arranged to be disposed in an opening 232 provided in the conductive sheath 23 (shown in FIG. 2). The projection 221*a* and the projection 221*b* are arranged to fix the location of the dielectric 22 in the conductive sheath 23. In the present preferred embodiment, the projection 221*a* preferably has a substantially rectangular shape and the projection 221*b* has a substantially semispherical shape. However, each of the projections may have any suitable shape. In this preferred embodiment, the dielectric 22 includes one projection 221*a* and one projection 221*b*. However, any suitable number of projections 221*a* and 221*b* may be provided in order to fix the location of the dielectric 22 with respect to the conductive sheath 23. In addition, any suitable location and arrangement of the projections 221*a* and 221*b* may used.

The contact portion 212 of the center conductor 21 is arranged in a trough 222*a* in the frame portion 222 such that the flat surface 212*a* and the curved surface 212*b* of the contact portion 212 is exposed in the trough 222*a* of the frame portion 222.

As best seen in FIG. 1, the conductive sheath 23 of the female portion 20 has a substantially square shape, and includes a plurality of resilient arms 233 extending from one side of the intermediate portion 235 and a plurality of terminals 234 extending from corner portions of the opposite side of the intermediate portion 235. However, the terminals 234 are not required to be disposed at corner portions of the intermediate portion 235, and instead, may be disposed at any suitable locations of the intermediate portion 235. The resilient arms 233 are arranged to engage a conductive sheath 43 of the male portion 40, which is described below. In this preferred embodiment, the terminals 234 of the conductive sheath 23 are arranged to extend through corresponding openings in a circuit board (not shown) and to be soldered therein. However, other attachment structures may be used, such as surface mount technology, solder balls, or crimp solder. In this preferred embodiment, two resilient arms 233 are provided along each of three edges of the intermediate portion 235 and one resilient arm 233 is provided along the fourth edge of the intermediate portion 235, for example. However, any suitable number and arrangement of resilient arms 233 may be provided along each edge of the intermediate portion 235. Alternatively, the resilient arms may be provided on the male portion 40, instead of the female portion 20.

A plurality of the female portions 20 of the contact 10 is typically disposed in a suitable female electrical connector 60, as shown in FIGS. 15A to 16D. The female portions 20 of the contact 10 may be used for each of contacts of the female electrical connector 60, or may be used for only a portion of the contacts of the female electrical connector 60.

Figure 15B:
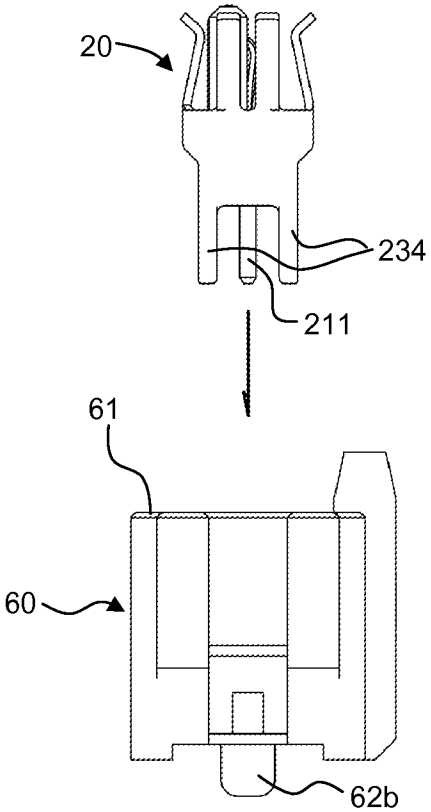
FIGS. 15A and 15B are views of female portions of electrical contacts being inserted into female electrical connectors according to a preferred embodiment of the present invention.
Figure 15A:
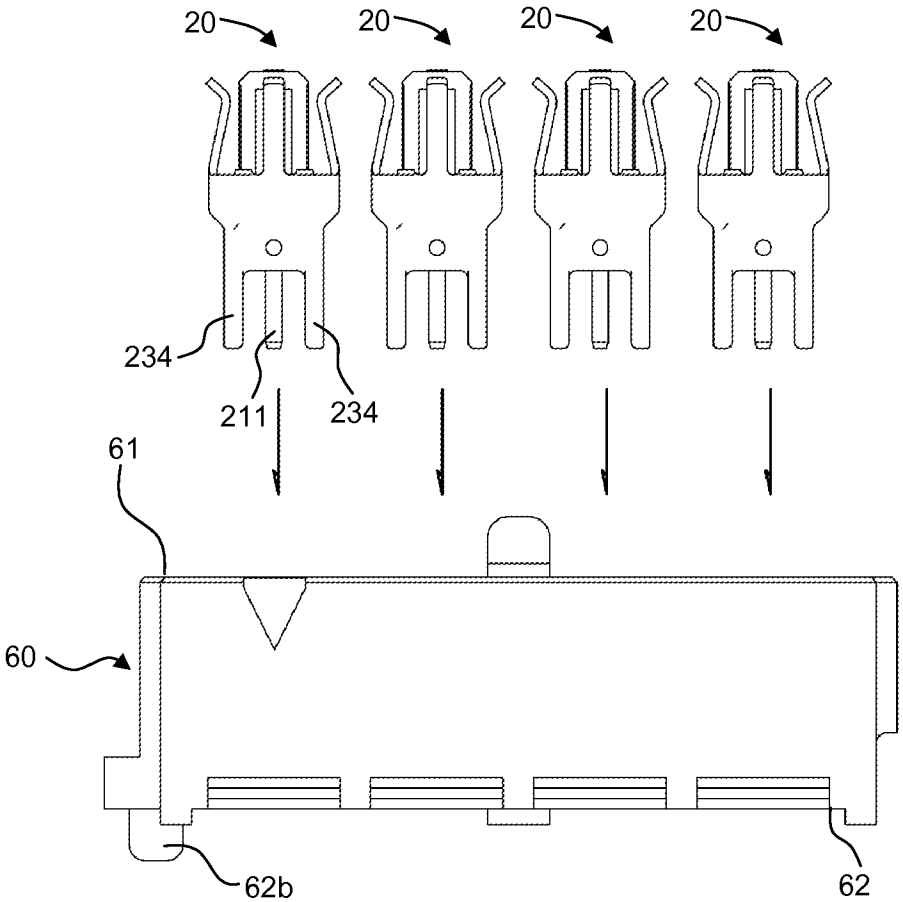
Figure 16D:
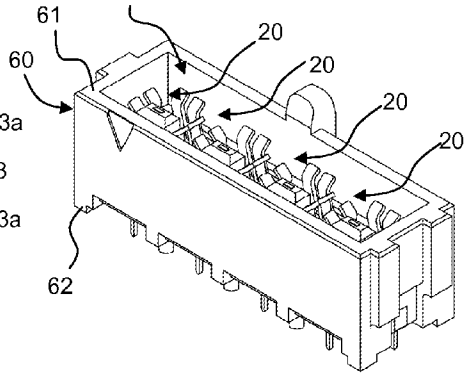
FIGS. 16A to 16D are views of the female portions of the electrical contacts that have been inserted into the female electrical connector as shown in FIGS. 15A and 15B.
Figure 16A:
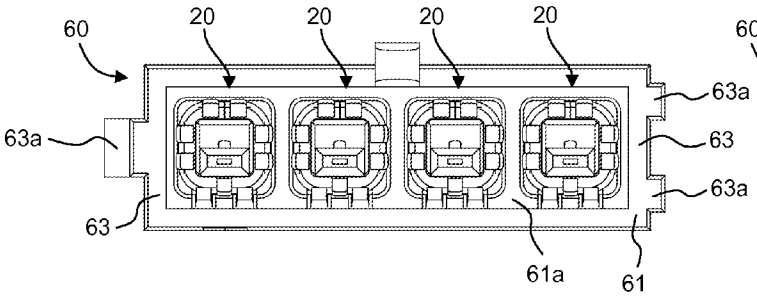
Figure 16C:
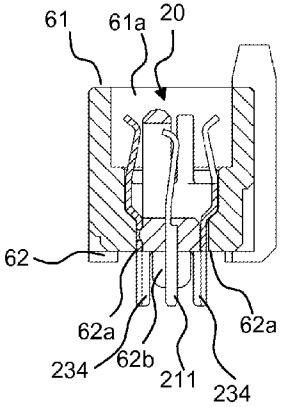
Figure 16B:
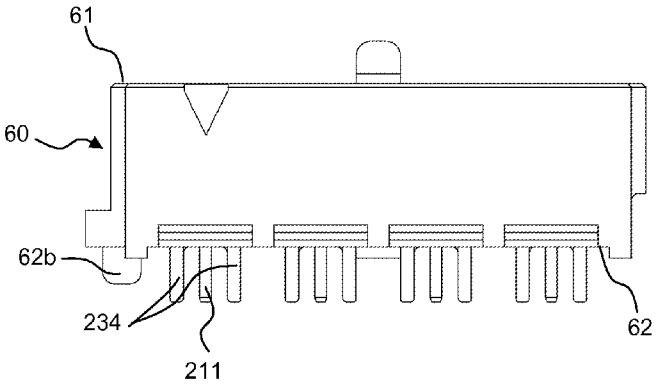
Figure 17D:
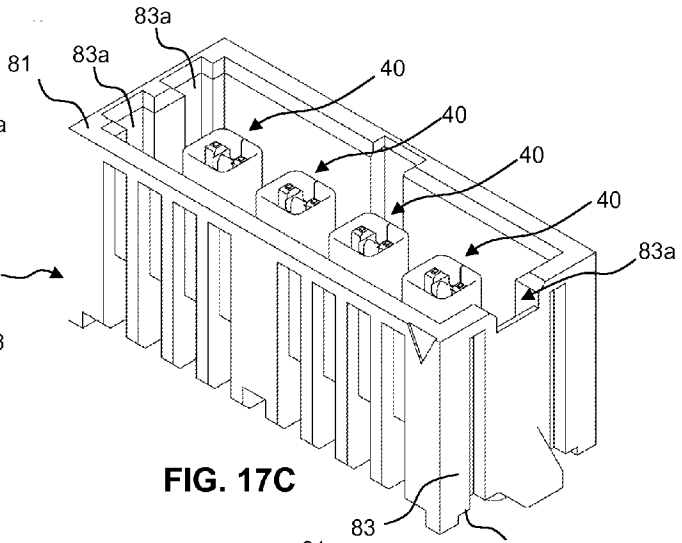
FIGS. 17A to 17D are views of male portions of electrical contacts that have been inserted into male electrical connectors according to a preferred embodiment of the present invention.
Figure 17A:
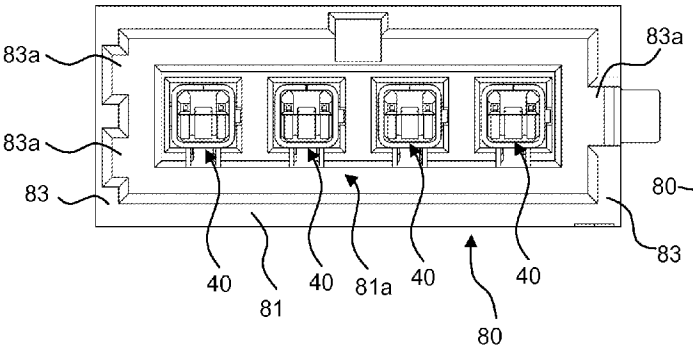
Figure 17C:
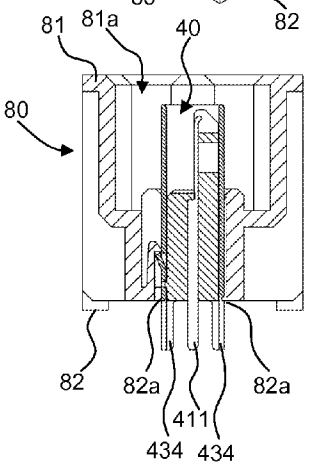
Figure 17B:
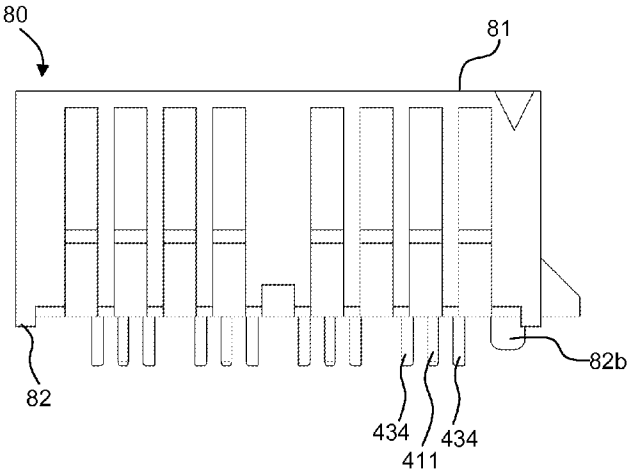
Figure 18:
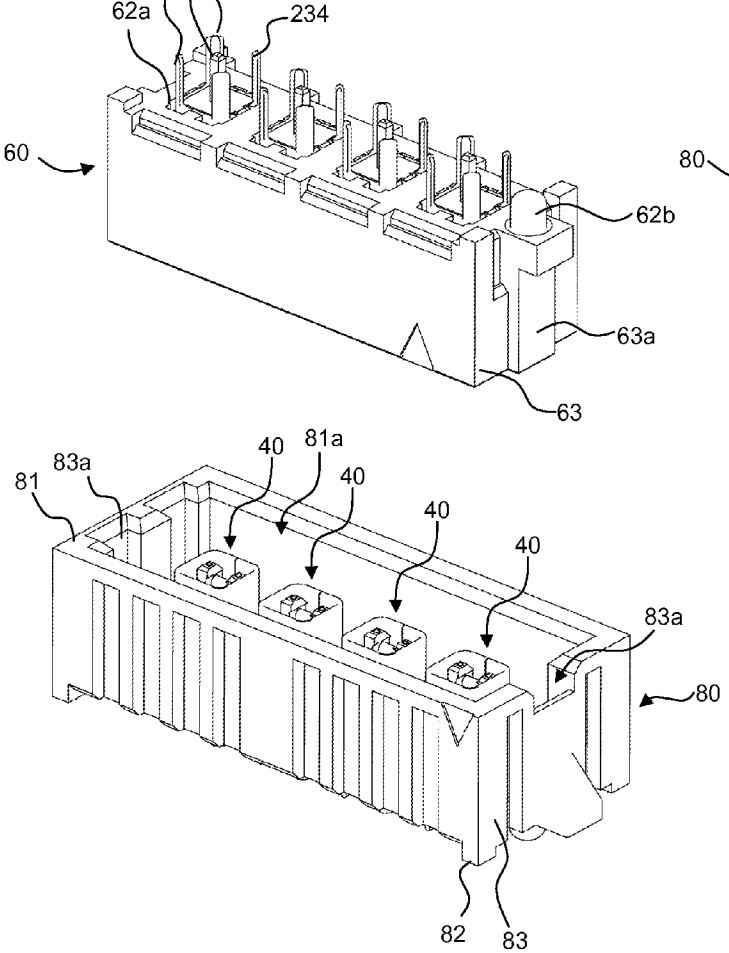
FIG. 18 is a view of the female electrical connector and the male electrical connector shown in FIGS. 15A to 17D in an arrangement to be mated with one another.

As shown in FIGS. 15A and 15B, each of the female portions 20 are inserted into an opening 61*a* (see FIG. 16A) in an upper surface 61 of the female electrical connector 60, such that the terminals 234 and the tail portion 211 of each of the female portions 20 extend outward from an opening 62*a* provided in the lower surface 62 of the female electrical connector 60. The arrangement of the female portions 20 in the female electrical connector 60 shown in FIGS. 15A to 16D is referred to as a ganged array. As shown in FIG. 18, the opening 62*a* has a substantially square geometry which corresponds to the substantially square geometry of the conductive sheath 23. Alternatively, the female electrical connector 60 may include any suitable number of openings having any suitable arrangement and shape, for example, the female electrical connector 60 may include individual openings through which each of the terminals 234 and the tail portion 211 extends.

The female electrical connector 60 includes polarization projections 63*a* on opposite end surfaces 63 of the female electrical connector 60 to ensure a proper orientation of the female electrical connector 60 with the male electrical connector 80 described below. In addition, the female electrical connector 60 includes an alignment projection 62*b* extending from the lower surface 62 thereof. The alignment projection 62*b* is arranged to engage an alignment hole on a circuit board (not shown) or other suitable connection structure. The arrangement and number of the polarization projections 63*a* and the alignment projection 62*b* are not specifically limited, and any suitable arrangement and number may be used.

FIGS. 7-12 show a male portion 40 of the contact assembly 10 or a partial portion of the male portion 40 according to a preferred embodiment of the present invention.

As seen in FIGS. 7-12, the male portion 40 preferably includes a center conductor 41 which extends through a dielectric 42, and the dielectric 42 is disposed within a conductive sheath 43.

Figure 12:
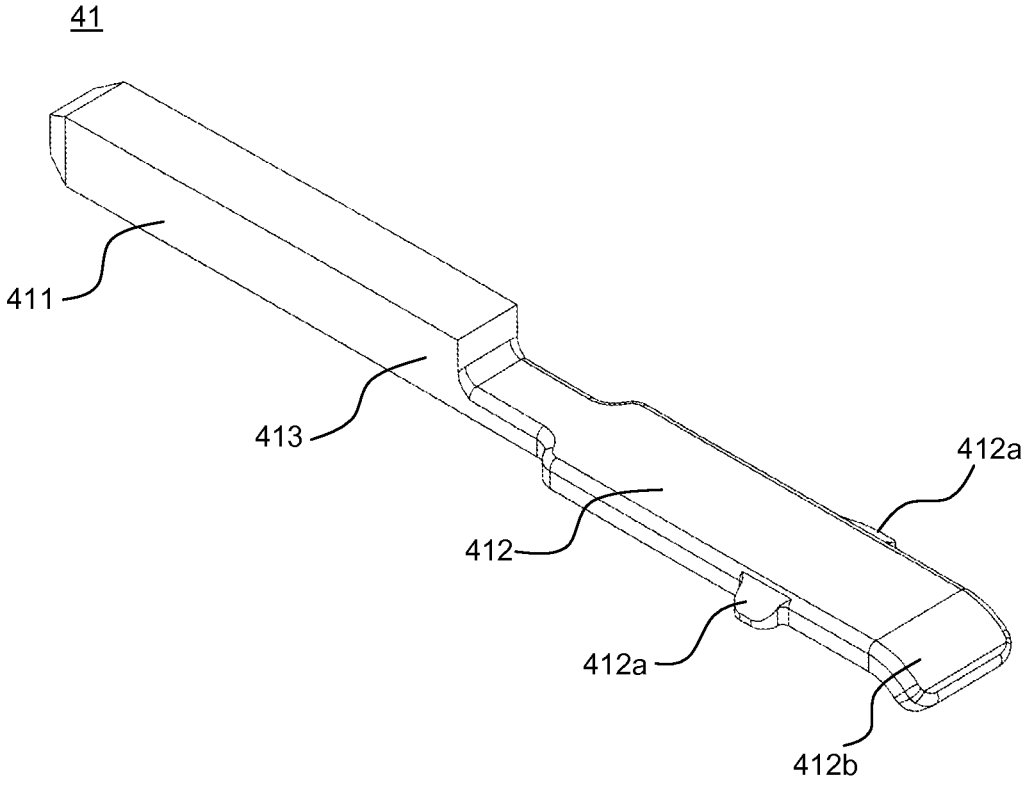
FIG. 12 is a perspective view of the center conductor of the female portion of the electrical contact shown in FIG. 7.

As best seen in FIG. 12, the center conductor 41 includes an intermediate portion 413 connecting a tail portion 411 and a contact portion 412. The contact portion 412 includes, for example, projections 412*a* disposed on opposite sides of the contact portion 412. The projections 412*a* are provided to engage with a portion of the dielectric 42 to fix the location of the center conductor 41 as shown, for example, in FIG. 10. However, any suitable fixing structure may be provided to fix the location of the center conductor 41 in the dielectric 42.

The contact portion 412 of the center conductor 41 is preferably configured to have a thickness that is approximately half of the thickness of the tail portion 411 and the intermediate portion 413 to enable the contact portion 412 to engage with the contact portion 212 of the female portion 20, such that the combined thickness of the contact portion 412 of the male portion 40 and the contact portion 212 of the female portion 20 is substantially the same as the thicknesses of the tail portions 411 and 211 and of the intermediate portions 413 and 213 of the center conductors 41 and 21, respectively. With this arrangement, the cross-sectional dimensions of the center conductors 21 and 41 are substantially constant along the entire length of the electrical contact 10, which results in very good signal integrity performance. In addition, the contact portion 412 preferably has a width that is greater than the width of the contact portion 212 of the center conductor 21 to allow for lateral movement which provides a substantial amount of misalignment tolerance when mating and using the female portion 20 and the male portion 40. However, the contact portion 412 may have a width that is substantially the same as the width of the contact portion 212 of the center conductor 21, if a significant amount of misalignment tolerance is not required.

The contact portion 412 has a substantially flat surface along substantially the entire length thereof. The substantially flat surface of the center conductor 41 is configured to be engaged with the flat portion 212*a* of the contact portion 212 of the center conductor 21. In addition, the contact portion 412 preferably includes an end portion 412*b* that extends away from the substantially flat surface of the contact portion 412 to facilitate engagement of the contact portion 412 of the center conductor 41 of the male portion 40 with the contact portion 212 of the center conductor of the male portion 20.

Figure 10:
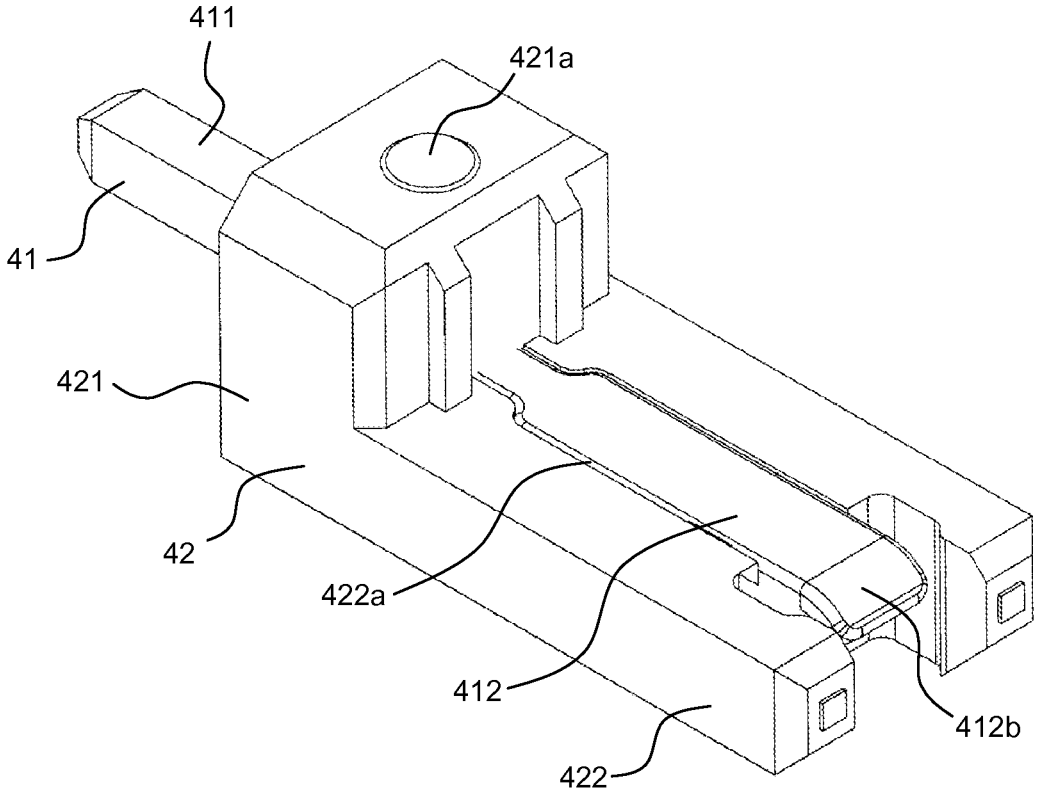
FIG. 10 is a perspective view of a partially assembled portion of the male portion of the electrical contact shown in FIG. 7.
Figure 11:
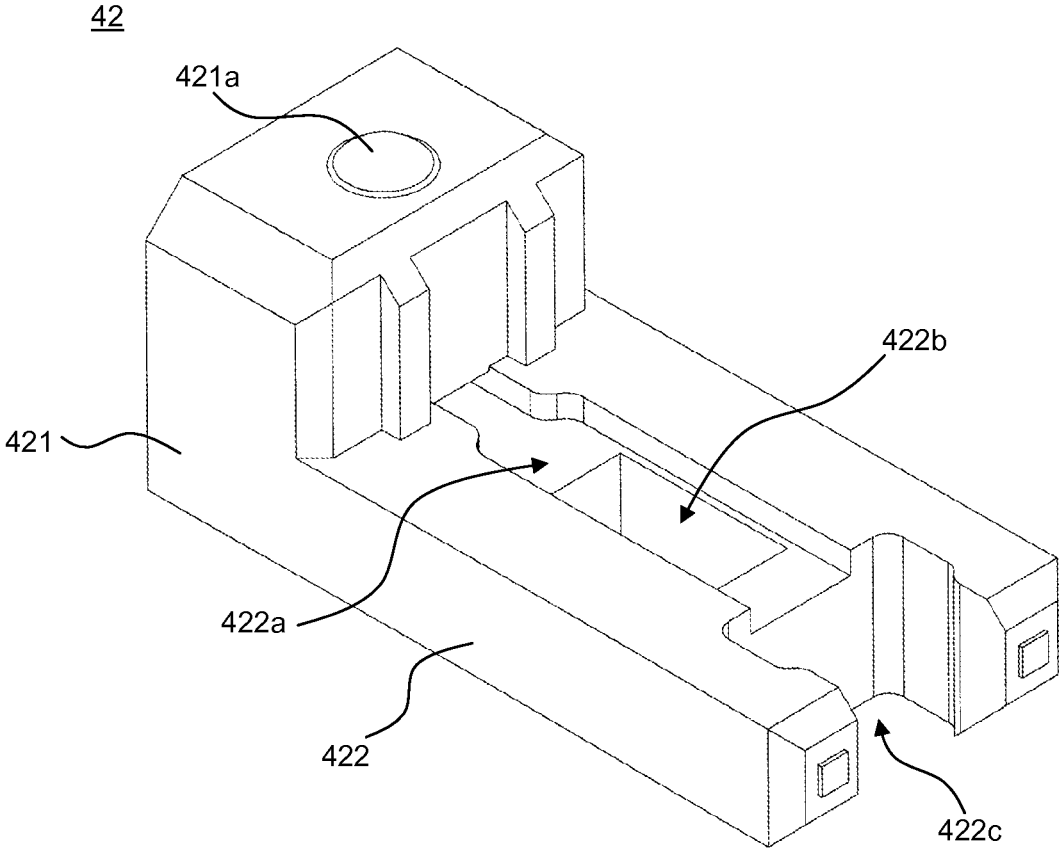
FIG. 11 is a perspective view of the dielectric of the male portion of the electrical contact shown in FIG. 7.

As best seen in FIGS. 10 and 11, the center conductor 41 is overmolded with the dielectric 42 such that the center conductor 41 is embedded in the dielectric 42. Any suitable molding method may be used, for example, injection molding. The dielectric 42 includes a block portion 421 and a support portion 422 which supports the contact portion 412 of the center conductor 41. Alternatively, the dielectric 42 may be formed with a through-hole extending therethrough, and the center conductor 41 may be inserted into the through-hole and press fit therein.

The block portion 421 includes a projection 421*a*. The support portion 422 of the dielectric 42 includes a groove 422*a* into which the contact portion 412 of the center conductor 41 is disposed. The groove 422*a* is formed during the overmolding process by the contact portion 412 of the center conductor 41. The projections 412*a* of the contact portion 412 are preferably embedded in the side surfaces of the groove 422*a* such that the contact portion 412 is fixed in the groove 422*a*. In addition, the support portion 422 of the dielectric 42 includes an opening 422*b* extending through the support portion 422 from a bottom surface of the groove 422*a* to an opposed surface of the support portion 422. The support portion 422 includes another opening 422*c* at an end thereof. The opening 422*c* is arranged to receive the end portion 412*b* of the center conductor 41.

The projection 421*a* of the block portion 421 is arranged to be engaged with an opening 432 of the conductive sheath 43. The projection 421*a* is arranged to fix the location of the dielectric 42 in the conductive sheath 43. In this preferred embodiment, the projection 421*a* preferably has a substantially semispherical shape. However, the projection 421*a* may have any suitable shape. In the preferred embodiment, the dielectric 42 includes one projection 421*a*. However, any suitable number of projections 421*a* may be provided in order to fix the dielectric 42 with respect to the conductive sheath 43. In addition, any suitable location and arrangement of projections 421*a* may be used.

Figure 7:
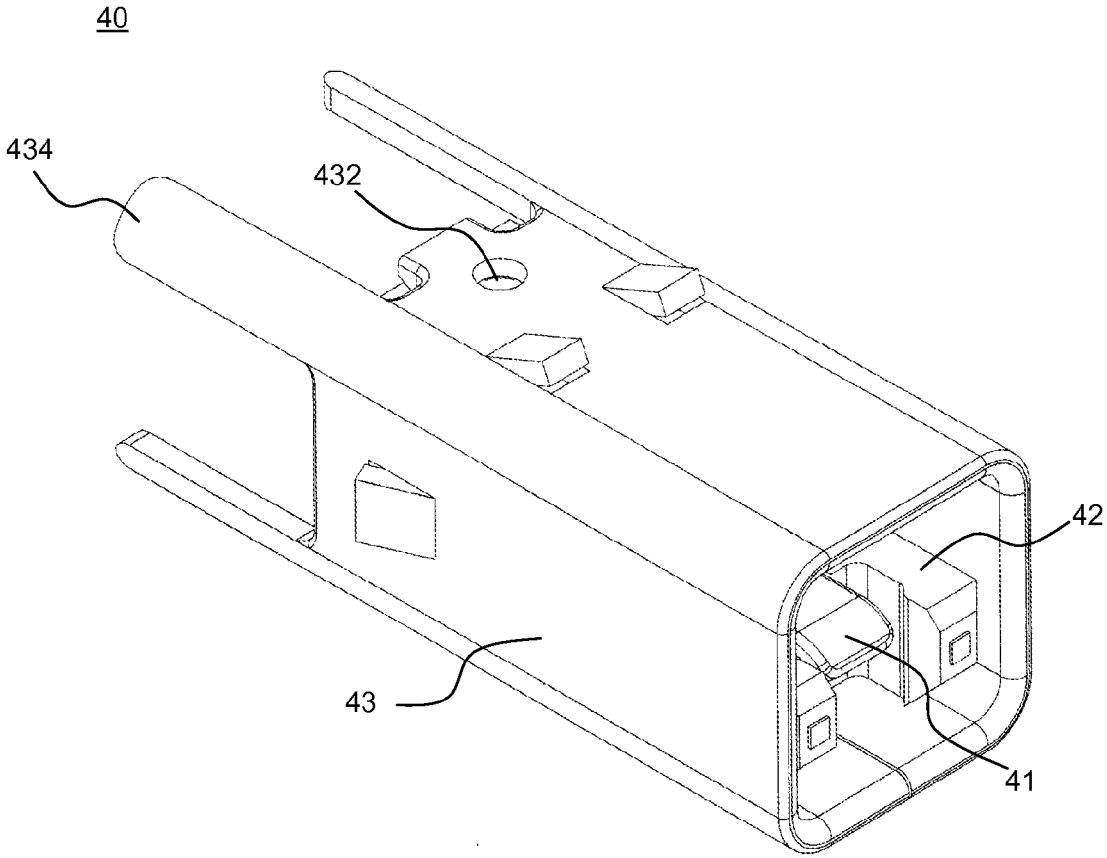
FIG. 7 is a perspective view of the male portion of the electrical contact according to a preferred embodiment of the present invention.
Figure 8:
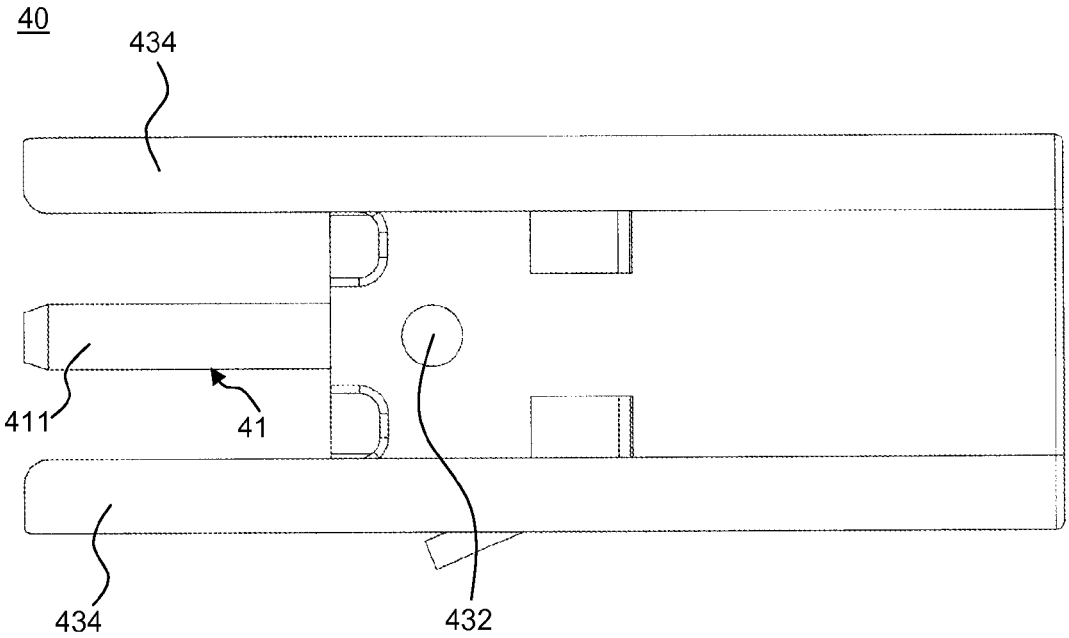
FIG. 8 is a side view of the male portion of the electrical contact shown in FIG. 7.

As best seen in FIG. 7, the conductive sheath 43 of the male portion 40 has a substantially square shape and includes a plurality of terminals 434 extending from corner portions of one end of the conductive sheath 43. However, the terminals 434 are not required to be disposed at corner portions of the conductive sheath 43, and instead, may be disposed at any suitable locations of the conductive sheath 43. In this preferred embodiment, the terminals 434 of the conductive sheath 43 are arranged to extend through corresponding openings in a circuit board and be soldered therein. However, other attachment structures may be used, such as surface mount technology, solder balls, or crimp solder.

A plurality of male portions 40 of the contact 10 is typically disposed in a suitable male electrical connector 80, as shown in FIGS. 17A to 17D. The male portions 40 may be used for each contact of the male electrical connector 80, or may be used for only a portion of the contacts of the male electrical connector 80.

Figure 19:
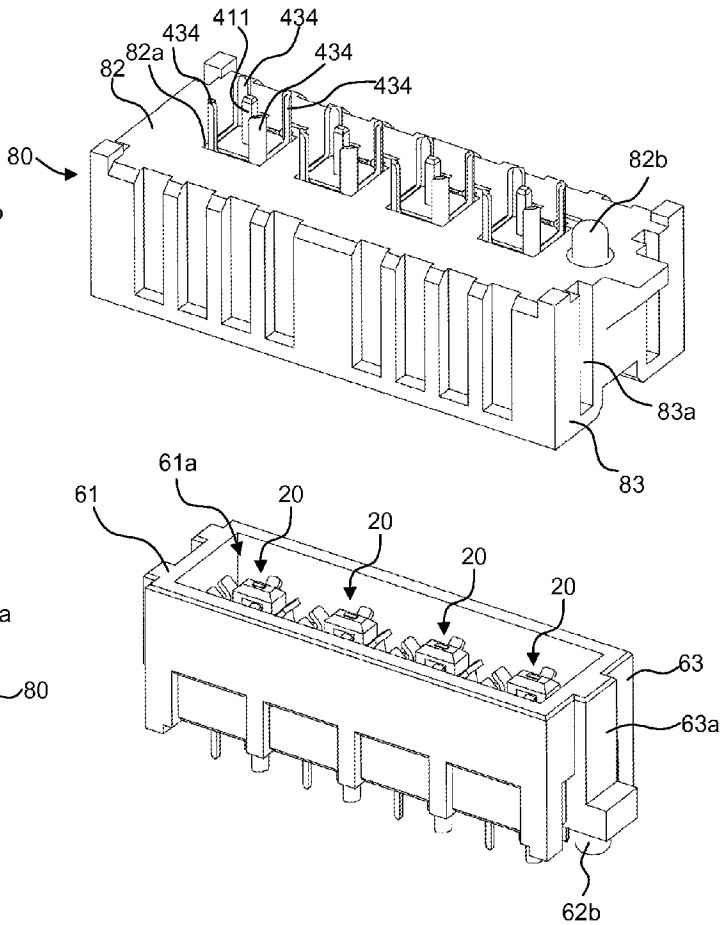
FIG. 19 is another view of the female electrical connector and the male electrical connector shown in FIGS. 15A to 17D in an arrangement to be mated with one another.

Each of the male portions 40 are inserted into an opening 81*a* (see FIG. 16C) in an upper surface 81 the male electrical connector 80, such that the terminals 434 and the tail portion 411 of each of the male portions 40 extend outward from an opening 82*a* provided in the lower surface 82 of the male electrical connector 80, in a similar manner that the female portions 20 are inserted into the opening 61*a* in the upper surface 61 of the female electrical connector 60 as shown in FIGS. 15A and 15B. The arrangement of the male portions 40 in the male electrical connector 80 shown in FIGS. 17A to 17D is referred to as a ganged array. As shown in FIG. 19, the opening 82*a* has a substantially square geometry which corresponds to the substantially square geometry of the conductive sheath 43, respectively. Alternatively, the male electrical connector 80 may include any suitable number of openings having any suitable arrangement and shape, for example, the male electrical connector 80 may include individual openings through which each of the terminals 434 and the tail portion 411 extends.

The male electrical connector 80 includes polarization cavities 83*a* on opposite end surfaces 83 of the male electrical connector 80 into which the polarization projections 63*a* of the female electrical connector 60 are disposed when the male electrical connector 80 is engaged with the female electrical connector 60 in the correct orientation. In addition, the male electrical connector 80 includes an alignment projection 82*b* extending from the lower surface 82 thereof. The alignment projection 82*b* is arranged to engage an alignment hole on a circuit board (not shown) or other suitable connection structure. The arrangement and number of the polarization cavities 83*a* and the alignment projection 82*b* are not specifically limited, and any suitable arrangement and number may be used.

As shown in FIGS. 18 and 19, the array of female portions 20 and the array of male portions 40 of the contacts 10 are arranged in respective female and male electrical connectors 60 and 80 such that the center conductor 211 of each of the array of the female portions 20 can be engaged with a respective center conductor 411 of each of the male portions 40. In the female and male electrical connectors 60 and 80 shown in FIGS. 15A to 19, a single row of female portions 20 and a single row of male portions 40 are provided. However, any suitable number and arrangement of female portions 20 and male portions 40 may be provided, such as a plurality of rows female portions 20 and a plurality of rows of male portions 40 arranged in a matrix, for example.

When the female electrical connector 60 is engaged with the male electrical connector 80, the polarization projections 63*a* are disposed in the polarization cavities 83*a* so as to ensure the correct orientation of the female electrical connector 60 with respect to the male electrical connector 80.

A preferred method of manufacturing the female portion 20 will now be described with reference to FIGS. 20A to 24B. The male portion 40 is manufactured using substantially the same method as that used to manufacture the female portion 20, and a description thereof is omitted.

Figure 20B:
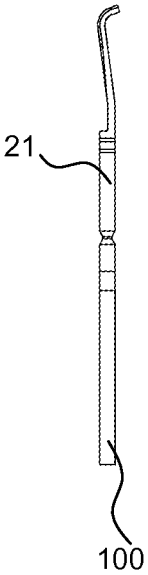
FIGS. 20A and 20B are views of a first step of a method for manufacturing a female portion according to a preferred embodiment of the present invention.
Figure 20A:
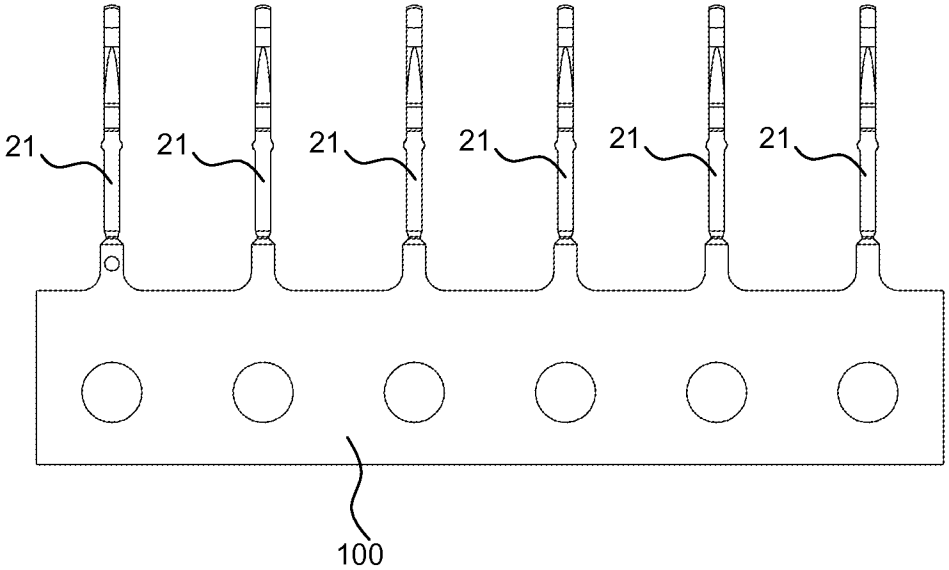
Figure 21B:
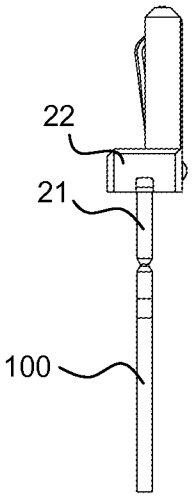
FIGS. 21A and 21B are views of a second step of a method for manufacturing a female portion according to a preferred embodiment of the present invention.
Figure 21A:
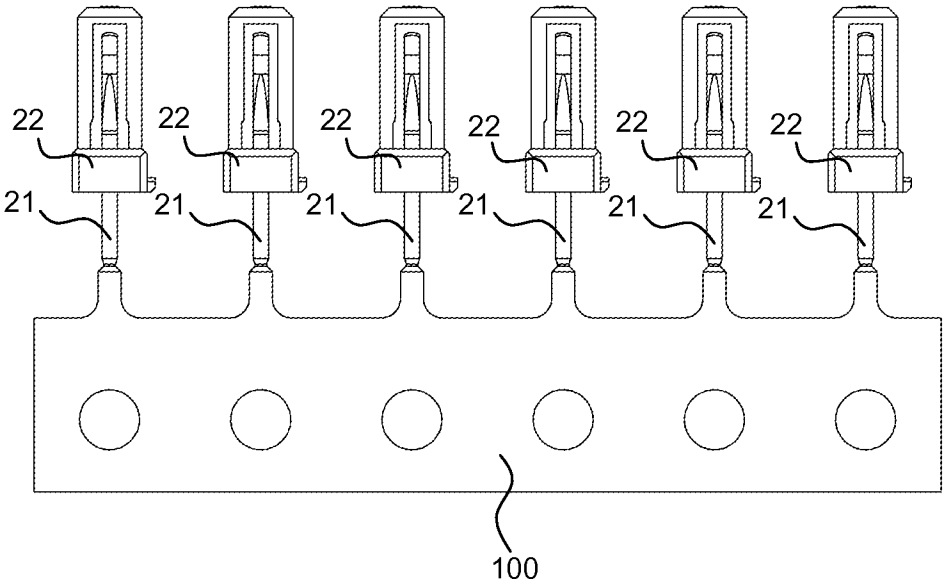

As shown in FIGS. 20A and 20B, a plurality of the center conductors 21 are formed on a strip 100. Then, as shown in FIGS. 21A and 21B, the dielectric 22 is formed by overmolding on each of the center conductors 21.

Figure 22B:
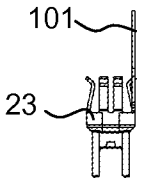
FIGS. 22A and 22B are views of a third step of a method for manufacturing a female portion according to a preferred embodiment of the present invention.
Figure 22A:
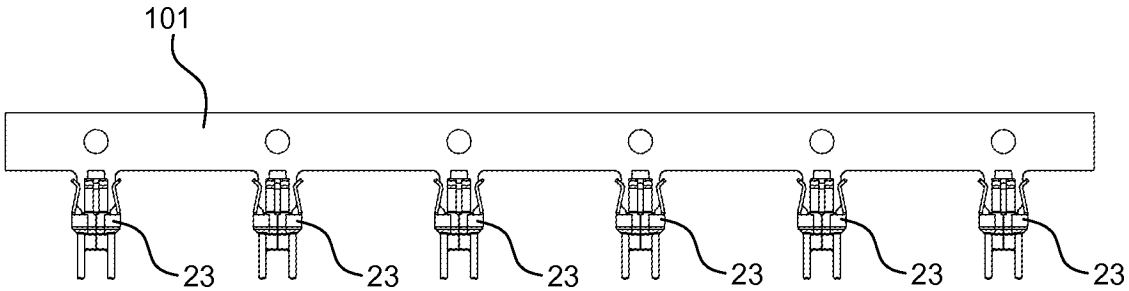
Figure 23B:
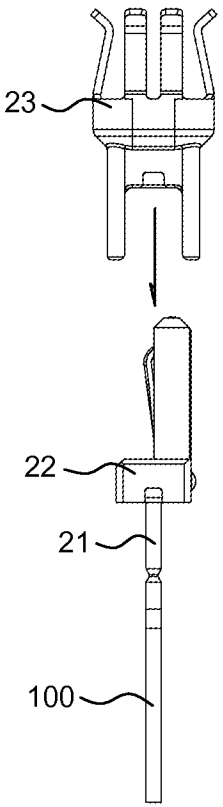
FIGS. 23A and 23B are views of a fourth step of a method for manufacturing a female portion according to a preferred embodiment of the present invention.
Figure 23A:
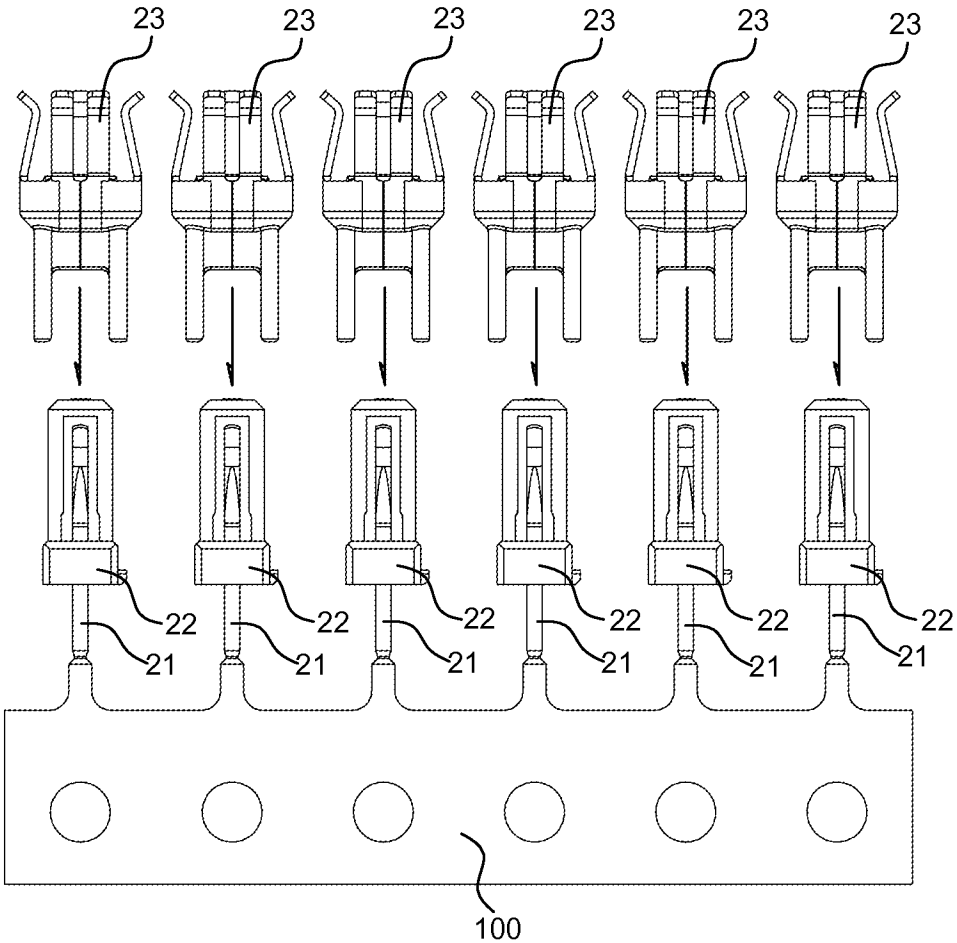
Figure 24B:
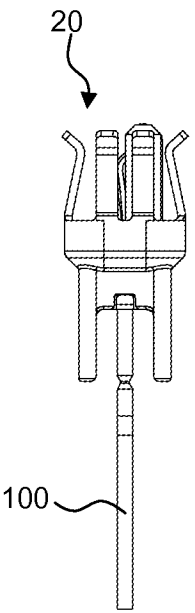
FIGS. 24A and 24B are views of a fifth step of a method for manufacturing a female portion according to a preferred embodiment of the present invention.
Figure 24A:
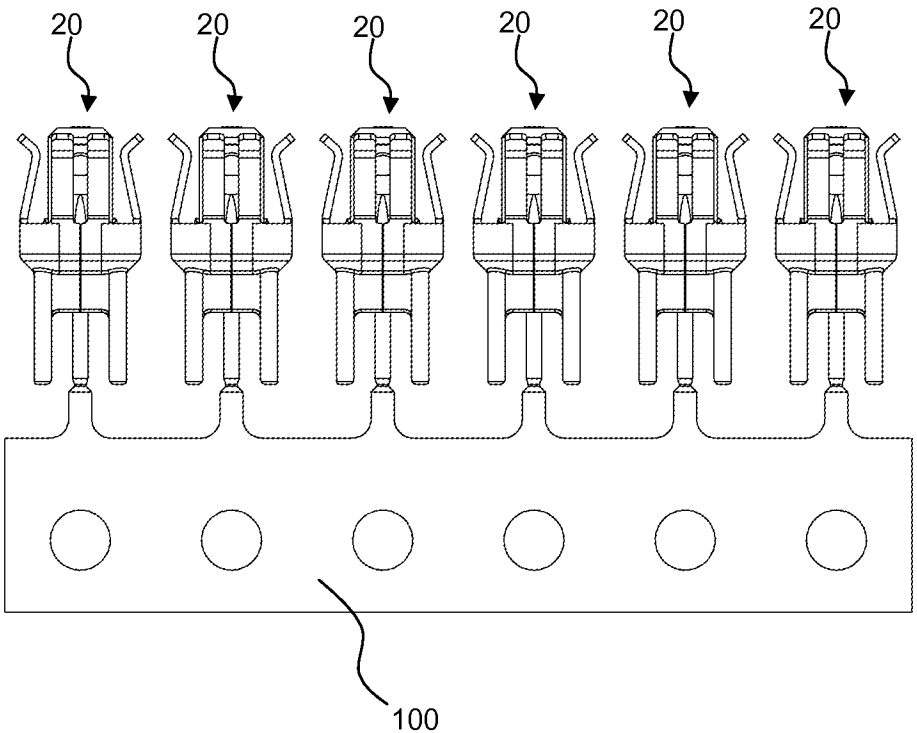

As shown in FIGS. 22A and 22B, a plurality of conductive sheaths 23 are formed on a strip 101. Particularly, the plurality of conductive sheaths 23 are formed of a metal plate that is initially stamped into a desired shape while being attached to the strip 101. The metal plate attached to the strip 101 is then bent and formed into the shape of the plurality of conductive sheaths 23 using progressive dies. Subsequently, the plurality of conductive sheaths 23 are removed from the strip 101. In the present preferred embodiment, the conductive sheaths 23 are formed by stamping and progressive die processes. However, any suitable processes may be used to form the conductive sheaths 23.

As shown in FIGS. 23A to 24B, each of the conductive sheaths 23 is mounted on a respective one of the dielectrics 22, such that the dielectrics 22 are inserted and fixed in a respective one of the conductive sheaths 23.

Once the conductive sheaths 23 are mounted on the dielectrics 22, each of the completed female contacts 20 is removed from the strip 100.

Although the dielectric 22 is overmolded on the center conductors 21 in the present preferred embodiment, the dielectrics 22 and 42 may be formed with a through-hole therein, and the center conductors 21 and 41 may be press fit into the through-holes provided in the dielectrics 22 and 42, respectively. Alternatively, each of the dielectrics 22 and 42 may have a clamshell structure in which each of the dielectrics 22 and 42 includes two halves which are configured to be mated together. With the clamshell structure, the two halves of the dielectrics 22 and 42 are mated together with a respective center conductor 21 and 41 disposed therebetween. Furthermore, other suitable methods may be used.

Although, in the preferred embodiment shown in shown in FIGS. 20A to 24B, a plurality of female contacts 20 are manufactured using a strip of conductive material, alternatively, each of the female contacts 20 may be individually formed.

Figure 9:
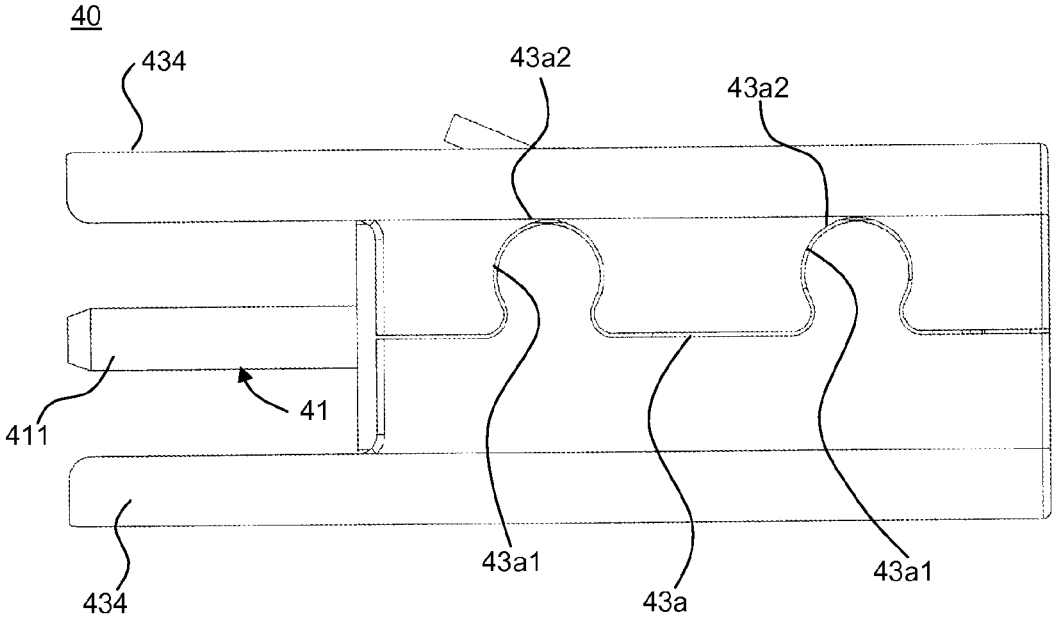
FIG. 9 is another side view of the male portion of the electrical contact shown in FIG. 7.

As shown in FIG. 1, the finally formed conductive sheath 23 includes substantially straight edges that extend substantially in a longitudinal direction of the conductive sheath 23 so as to form a seam 23*a*. As seen in FIG. 9, the finally formed conductive sheath 43 includes adjacent edges having complementary locking elements 43*a*1 and 43*a*2 forming a seam 43*a*. The complementary locking elements 43*a*1 and 43*a*2 along the seam 43*a* are provided to prevent the adjacent edges from separating from one another. In this preferred embodiment, the locking elements preferably have a substantially circular shape. However, the complementary locking elements 43*a*1 and 43*a*2 may have any suitable complementary shapes. Alternatively, the complementary locking elements may be provided along the adjacent edges of seam 23*a* of the conductive sheath 23, or the complementary locking elements may be omitted completely.

Figure 13:
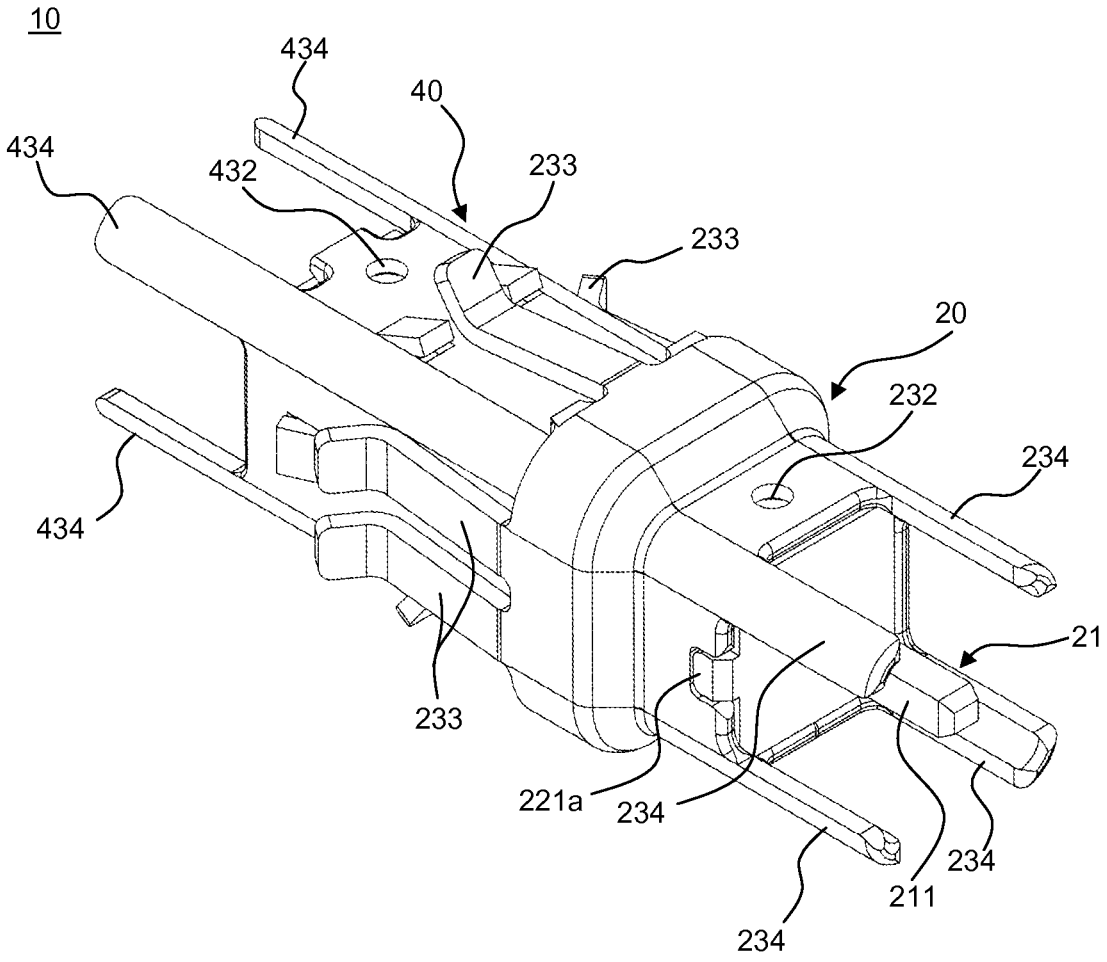
FIG. 13 is a perspective view of the electrical contact according to a preferred embodiment of the present invention in a state in which the female portion and the male portion of the electrical contact are engaged with each other.
Figure 14:
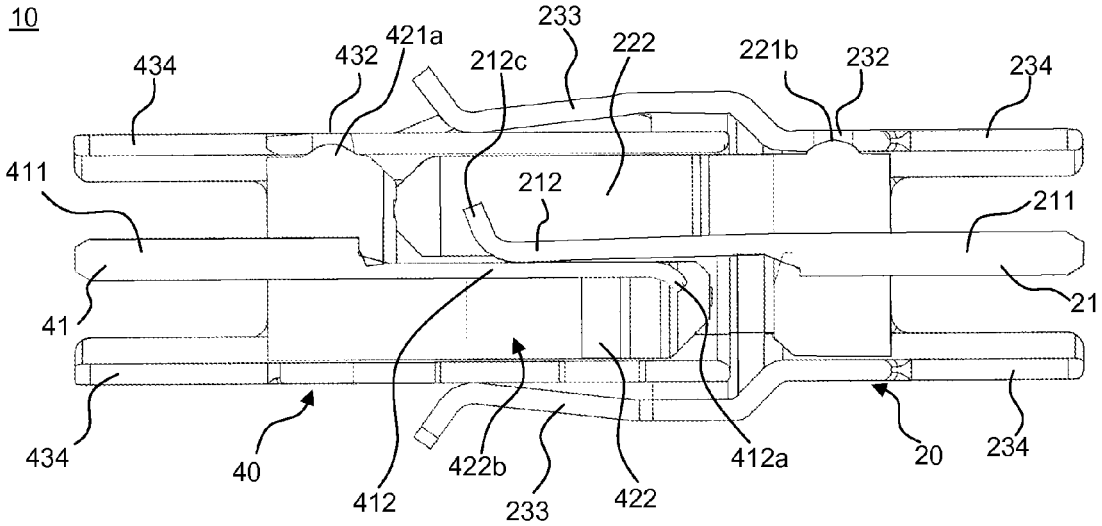
FIG. 14 is a sectional view of the electrical contact shown in FIG. 13.

As shown in FIGS. 13 and 14, the female portion 20 and the male portion 40 of the electrical contact 10 are configured to be mateable with one another. When the female portion 20 and the male portion 40 are mated, the resilient arms 233 of the conductive sheath of the female portion 20 are engaged with an outer surface of the conductive sheath 43 of the male portion 40. In addition, as seen in FIG. 14, when the female portion 20 and the male portion 40 are engaged, the frame portion 222 of the dielectric 22 and the support portion 422 of the dielectric 42 are disposed adjacent to each other, and the contact portion 212 of the center conductor 21 and the contact portion 412 of the center conductor are securely engaged with each other between the frame portion 222 and the support portion 422. Alternatively, the resilient arms may be provided on the conductive sheath 43 of the male portion 40 and arranged to engage an outer surface of the conductive sheath 23 of the female portion 20. Alternatively, instead of engaging the outer surface of the conductive sheath, the resilient arms may be configured to engage an inner surface of the conductive sheath.

In the electrical contact 10 according to this preferred embodiment of the present invention, since the contact portions 212 and 412 have thicknesses that are substantially half the thickness of the tail portions 211, 411, when the female portion 20 and the male portion 40 of the electrical contact are engaged with one another, the combined cross-sectional dimensions of the engaged contact portions 212 and 412 are substantially the same as the cross-sectional dimensions of the tail portions 211 and 411 and the intermediate portions 213 and 413. Thus, a consistent geometry of the electrical contact 10 is maintained throughout the entire length of the electrical contact 10, and signal integrity discontinuities are minimized.

Since the substantially square-shaped components of the electrical contact 10 can be manufactured using stamping, molding, and progressive die methods, the electrical contact 10 can be manufactured more quickly and at a reduced cost as compared to the screw machining method that is required to manufacture coaxial contacts. In addition, the manufacturing tolerances required for the electrical contact 10 according to the preferred embodiments of the present invention are substantially less tight as compared to the manufacturing tolerances required for a coaxial contact.

The center conductors 21 and 41 and the conductive sheaths 23 and 43 are preferably made of a copper alloy. However, any suitable conductive material may be used. The dielectric is preferably made of plastic. However, any suitable dielectric material may be used.

The conductive sheath 23 of the female portion 20 preferably has inner dimensions that are greater than the outer dimensions of the conductive sheath 43 of the male portion such that the misalignment tolerances of the contact 10 can be increased.

It should be understood that the foregoing description is only illustrative of the present invention. Various alternatives and modifications can be devised by those skilled in the art without departing from the present invention. Accordingly, the present invention is intended to embrace all such alternatives, modifications and variations which fall within the scope of the appended claims.

What is claimed is:

1. An electrical contact:

a female portion including:

a conductive sheath;

a dielectric disposed within the conductive sheath; and a center conductor extending through the dielectric; and a male portion including:

a conductive sheath;

a dielectric disposed within the conductive sheath; and a center conductor extending through the dielectric; wherein the female portion and the male portion are arranged to be engageable with one another;

the conductive sheath, center conductor, and dielectric of each of the female portion and the male portion have a substantially square shape;

each of the center conductors of the female portion and the male portion includes a contact portion arranged to be engaged with one another when the female portion and the male portion are engaged with one another; and the contact portion of each of the center conductors of the female portion and the male portion has a thickness of substantially half of a thickness of the remaining portions of the center conductors.

2. The electrical contact according to claim 1, wherein the contact portion of the center conductor of the male portion has a width that is greater than a width of the contact portion of the center conductor of the female portion.

3. The electrical contact according to claim 1, wherein the conductive sheath of the female portion has inner dimensions that are greater than outer dimensions of the conductive sheath of the male portion such that a space is provided between the conductive sheath of the female portion and the conductive sheath of the male portion.

4. The electrical contact according to claim 1, wherein the conductive sheath of the female portion has inner dimensions that are greater than outer dimensions of the conductive sheath of the male portion.

5. The electrical contact according to claim 1, wherein the dielectric of the female portion includes a block portion and a frame portion extending from the block-shaped portion;

the frame portion has an opening extending therethrough; and the contact portion of the center conductor of the female portion is disposed adjacent to the opening in the frame-shaped portion.

6. The electrical contact according to claim 5, wherein the block portion of the dielectric of the female portion includes a through-hole extending therethrough;

the center conductor of the female portion includes at least one projection extending from an intermediate portion thereof; and the center conductor of the female portion extends through the opening in the block portion of the dielectric of the female portion such that the at least one projection is engaged with a side surface of the through-hole in the block portion of the dielectric of the female portion.

7. The electrical contact according to claim 1, wherein the dielectric of the male portion includes a block portion and a support portion extending from the block portion;

the support portion has a groove disposed in a surface thereof; and the contact portion of the center conductor of the male portion is disposed in the groove in the surface of the support portion.

8. The electrical contact according to claim 7, wherein the support portion of the dielectric of the male portion further includes an opening extending through the support portion from a surface of the groove to a surface of the support portion opposite to the surface in which the groove is disposed.

9. The electrical contact according to claim 1, wherein the female portion includes a plurality of resilient arms arranged to resiliently engage an outer surface of the male portion when the female portion and the male portion are engaged with one another.

10. The electrical contact according to claim 1, wherein the conductive sheath of the female portion includes an opening in an intermediate portion thereof; and the dielectric of the female portion includes a projection arranged to engage the opening in the conductive of the female portion when the dielectric of the female portion is disposed in the conductive sheath of the female portion.

11. The electrical contact according to claim 1, wherein the conductive sheath of the male portion includes an opening in an intermediate portion thereof; and the dielectric of the male portion includes a projection arranged to engage the opening in the conductive of the male portion when the dielectric of the male portion is disposed in the conductive sheath of the male portion.

12. The electrical contact according to claim 1, wherein the conductive sheath of the female portion includes a plurality of terminals extending from an intermediate portion thereof; and the plurality of terminals are arranged to be disposed and soldered in holes provided in a circuit board.

13. The electrical contact according to claim 1, wherein the conductive sheath of the male portion includes a plurality of terminals extending from an intermediate portion thereof; and the plurality of terminals are arranged to be disposed and soldered in holes provided in a circuit board.

14. The electrical contact according to claim 1, wherein the conductive sheath of the female portion includes a seam extending substantially in a longitudinal direction of the conductive sheath of the female portion at which two edges of the conductive sheath of the female portion are adjacent to one another.

15. The electrical contact according to claim 1, wherein the conductive sheath of the male portion includes a seam extending substantially in a longitudinal direction of the conductive sheath of the male portion at which two edges of the conductive sheath of the male portion are adjacent to one another.

16. The electrical contact according to claim 15, wherein the edges of the conductive sheath of the male portion adjacent to one another include complementary locking elements arranged to interconnect with one another.

17. An electrical contact:

a coaxial female portion including:

a conductive sheath made of a stamped metal sheet;

a dielectric disposed within the conductive sheath; and a center conductor extending through the dielectric; and a coaxial male portion including:

a conductive sheath made of a stamped metal sheet;

a dielectric disposed within the conductive sheath; and a center conductor extending through the dielectric; wherein the female portion and the male portion are arranged to be engageable with one another;

each of the center conductors of the female portion and the male portion includes a contact portion arranged to be engaged with one another when the female portion and the male portion are engaged with one another; and the contact portion of each of the center conductors of the female portion and the male portion has a thickness of substantially half of a thickness of the remaining portions of the center conductors.

18. An electrical contact according to claim 17, wherein the conductive sheath, center conductor, and dielectric of each of the female portion and the male portion have a substantially square shape.

* * * * *